US011113931B2

(12) United States Patent
Smart et al.

(10) Patent No.: US 11,113,931 B2
(45) Date of Patent: Sep. 7, 2021

(54) ARCADE GAME WITH ROTATING CONTAINER FOR CAPTURED PRIZES WITH RFID TAGS

(71) Applicant: Smart Industries Corporation, Des Moines, IA (US)

(72) Inventors: Jeffrey T. Smart, Altoona, IA (US); Jimmy G. Dupree, Jr., Des Moines, IA (US); Alex Whiteaker, Bradenton, FL (US); Tyler Wampler, Bradenton, FL (US); Loren Ostema, Bradenton, FL (US)

(73) Assignee: Smart Industries Corporation, Des Moines, IA (US)

( * ) Notice: Subject to any disclaimer, the term of this patent is extended or adjusted under 35 U.S.C. 154(b) by 39 days.

(21) Appl. No.: 16/659,131

(22) Filed: Oct. 21, 2019

(65) Prior Publication Data

US 2020/0126366 A1 Apr. 23, 2020

Related U.S. Application Data

(60) Provisional application No. 62/748,100, filed on Oct. 19, 2018.

(51) Int. Cl.
*G07F 17/32* (2006.01)

(52) U.S. Cl.
CPC ..... *G07F 17/3297* (2013.01); *G07F 17/3216* (2013.01); *G07F 17/3223* (2013.01)

(58) Field of Classification Search
CPC .... G07F 17/3297; G07F 17/3216; A63F 9/30; A63F 2009/2489
See application file for complete search history.

(56) References Cited

U.S. PATENT DOCUMENTS

| | | | |
|---|---|---|---|
| 5,855,375 | A | 1/1999 | Wilcox et al. |
| 6,283,475 | B1 | 9/2001 | Stubben |
| 6,634,940 | B2 | 10/2003 | Yoshida et al. |
| 6,770,001 | B1 | 8/2004 | Shoemaker, Jr. |

(Continued)

FOREIGN PATENT DOCUMENTS

KR 1020110032317 A 3/2011

OTHER PUBLICATIONS

Ticket-Smarts, https://www.youtube.com/watch?v=DMW_kY07vDs, published on Nov. 2, 2016, viewed on Internet on Jul. 22, 2019.

*Primary Examiner* — Jay Trent Liddle
(74) *Attorney, Agent, or Firm* — McKee, Voorhees & Sease, PLC

(57) ABSTRACT

An arcade game includes a rotating and tilting prize receptacle for rotating captured prizes past an RFID antenna and dumping captured prizes back into the playing area. To improve the accuracy of reading RFID tags on the prizes, the receptacle spins to pass the captured prizes past the antenna multiple times. Each RFID tag may be assigned a serial number that is read by the RFID reader to assure that captured prizes are not counted multiple times. After the RFID tags have been read, the receptacle is tilted, preferably while still spinning, to dump the prizes back into the playing area. The captured-prize handling apparatus may include a lighted tower that surrounds the electro-mechanical elements and attracts attention to the game. The receptacle is shaped to urge the captured prizes into a position within the receptacle that enhances accurate reading of the RFID tags.

20 Claims, 13 Drawing Sheets

(56) References Cited

U.S. PATENT DOCUMENTS

| | | | | |
|---|---|---|---|---|
| 6,991,230 | B1 | 1/2006 | Shoemaker | |
| 7,513,505 | B2 | 4/2009 | Berman et al. | |
| 7,549,266 | B2 | 6/2009 | Yuyama et al. | |
| 7,562,791 | B2 | 7/2009 | Yuyama et al. | |
| 7,783,383 | B2 | 8/2010 | Eliuk et al. | |
| 7,857,318 | B1 | 10/2010 | Shoemaker, Jr. et al. | |
| 8,251,369 | B2 | 8/2012 | Verstraeten | |
| 8,579,733 | B2 | 11/2013 | McGrath | |
| 9,135,403 | B1 | 9/2015 | Tolmosoff | |
| 9,153,092 | B2 | 10/2015 | Lachance et al. | |
| 9,552,703 | B2 | 1/2017 | Shoemaker, Jr. | |
| 2002/0067002 | A1* | 6/2002 | Yoshida | A63F 9/30 273/447 |
| 2004/0048659 | A1 | 3/2004 | Seelig et al. | |
| 2006/0170164 | A1 | 8/2006 | Watanabe | |
| 2008/0048869 | A1 | 2/2008 | Wang et al. | |
| 2009/0218393 | A1 | 9/2009 | Huang et al. | |
| 2010/0145507 | A1 | 1/2010 | Blust et al. | |
| 2010/0090408 | A1 | 4/2010 | Fukazawa et al. | |
| 2010/0287880 | A1 | 11/2010 | Yasunaga et al. | |
| 2011/0086687 | A1 | 4/2011 | Guarnieri | |
| 2011/0180998 | A1 | 7/2011 | Verstraeten | |
| 2011/0272887 | A1 | 11/2011 | McGrath | |
| 2015/0018058 | A1 | 1/2015 | Sato et al. | |
| 2015/0060482 | A1 | 3/2015 | Murray et al. | |
| 2016/0140811 | A1 | 5/2016 | Verstraeten | |
| 2017/0352228 | A1* | 12/2017 | Kramer | G07F 17/3295 |
| 2018/0028905 | A1* | 2/2018 | Shoemaker, Jr. | A63F 9/30 |
| 2018/0137718 | A1 | 5/2018 | Smart et al. | |
| 2018/0264353 | A1 | 9/2018 | Chu et al. | |
| 2018/0276954 | A1* | 9/2018 | Chu | G07F 17/3223 |
| 2019/0251795 | A1* | 8/2019 | Smart | G07F 17/3248 |
| 2020/0013253 | A1* | 1/2020 | Dote | A63F 9/30 |

* cited by examiner

ARCADE GAME WITH ROTATING CONTAINER FOR CAPTURED PRIZES WITH RFID TAGS

CROSS REFERENCE TO RELATED APPLICATION

This application claims priority under 35 U.S.C § 119 to provisional application Ser. No. 62/748,100 filed Oct. 19, 2018, the entire contents of which are hereby incorporated by reference.

FIELD OF THE INVENTION

The invention relates generally to arcade games. More specifically, the invention relates to arcade games where a player captures a physical prize.

BACKGROUND OF THE INVENTION

Crane-style arcade games have an electronic control system and a mechanical system that allows a player to purchase a chance to capture a prize by skillful manipulation of player controls. The controls include a joystick and/or buttons. These controls allow the player to move a crane head in front/back and left/right directions above a supply of prizes and then drop a claw which will pick up prize merchandise if skillfully and properly manipulated. When the claw drops to the bottom of its travel, the electronic control system closes the claw. The closing of the claw may grasp one or more prizes, or may remain empty. The control system then raises the claw, positions it over a prize delivery chute and releases any prizes held by the claw. Motors are used to move the crane head and to move the claw up and down. The claw is activated by a solenoid. The equipment operator can preset the nominal strength of the claw solenoid to adjust the skill level required to win. A stronger force applied by the claw generally increases the chances that a prize will be grasped; whereas a lower force makes winning prizes more difficult. Operators will therefore set the gripping strength at a level that maximizes profit by rewarding play without costing too much in prizes. The strength level may be variable within a session to encourage repeated play, for example by increasing as more money is spent on playing.

Traditionally, crane-type arcade games are filled with a number of different prizes, toys or other novelty items. For example, the game may include stuffed animals, sport balls, baseball hats, plastic football/baseball helmets, stickers, jewelry, etc. The user would then manipulate the crane or arm as described above over the desired prize within the game and elect to deploy the crane or arm to try and grab the prize. If the crane successfully picked up the prize, the prize would be dispensed to the user/player. The user could then make use of the item they won.

However, developments in the arcade gaming industry have led to changes in how prizes are managed, and the types of prizes included in many arcades. One common arrangement is for players to be awarded tickets by various games within an arcade. A player can accumulate tickets from many different arcade games, and then redeem the tickets for a variety of prizes that are assigned ticket values. For this reason, crane games have been developed where the prizes, such as toys and novelty items have been replaced by rolls of tickets or other physical items that are marked with a ticket value. However, these tickets or may be lost, stolen, or misplaced. Furthermore, there is a need to store the redeemed tickets at the validation site and return the tickets to the machine at a later time. Due to being handled by users the tickets tend to rather quickly degrade and become unusable, requiring frequent replacement of the tickets.

Accordingly, games have been developed wherein prizes are assigned point values programmed onto an attached RFID tag and instead of winning the prize, the player wins points that are read off the RFID tags as the prizes are captured. One example is shown in co-owned U.S. patent application Ser. No. 15/809,319, which is hereby incorporated by reference. The invention disclosed in that application stores captured prizes within the machine in a storage area that is remote from the playing field and the operator periodically manually returns the captured prizes to the playing area. It would be advantageous to have a mechanism for returning the prizes to the playing area automatically.

It is also known to use a tiltable receptacle within a crane-type arcade to retain captured prizes while their RFID tags are being read, and then tilt the receptacle to dump the prizes back into the playing area after the tags have been read. However, to date, these tiltable receptacle designs have been plagued with faulty sensing of the RFID tags, especially in situations when more than a single prize has been captured during one play. Furthermore, these designs tend to dump the prizes back into the playing area in the same location each time, which can lead to hilling or a clustered pile of prizes in one location which is undesirable.

Accordingly, there is a need for an improved arcade game that accurately reads RFID tags associated with electro-mechanically captured prizes and automatically returns the prizes to the playing area without creating a pile in one location.

SUMMARY OF THE INVENTION

Therefore, it is a primary object, feature, and/or advantage of the invention to improve on and/or overcome the deficiencies in the art.

According to one embodiment, the present invention is an arcade game that has a prize display area within a housing and a prize receptacle adjacent to the prize display area. An electro-mechanical prize capturing device mounted in the housing is adapted to capture a physical prize having a marker with an assigned value from the prize display area within the housing and move the prize to the prize receptacle. A rotation device spins the prize receptacle about a generally vertical axis when one or more prizes have been received in the prize receptacle. A marker reader proximate to the prize receptacle reads the marker on a captured prize within the receptacle as the marker is moved past the reader in the rotating receptacle. A tilting mechanism tilts the receptacle after the marker reader has read the marker to thereby dump the captured prize back into the prize display area. The marker may be an RFID tag and the marker reader may be an RFID antenna. The prize may be a roll of tickets. The electro-mechanical prize capturing device may be a crane and claw. The receptacle may be a bowl having a convex center portion that urges prizes toward an outer wall of the bowl. The rotation device may tilt with the receptacle such that the rotation device can rotate the receptacle when the receptacle is in a horizontal prize retaining orientation and when the receptacle is in a tilted prize dumping orientation. The game may be adapted to continue spinning the prize receptacle as prizes are dumped from the prize receptacle in order to impart sideways motion on the dumped prizes to prevent dumping the prizes into a pile directly beneath the receptacle. The marker reader may be adapted to sense a unique serial number for each captured prize in order to prevent crediting the same prize more than one time. The receptacle may be supported on a support tower, and wherein the support tower includes an array of LED lights.

These and/or other objects, features, and advantages of the invention will be apparent to those skilled in the art. The invention is not to be limited to or by these objects, features and advantages. No single embodiment need provide each and every object, feature, or advantage.

DETAILED DESCRIPTION

Figure 1A:
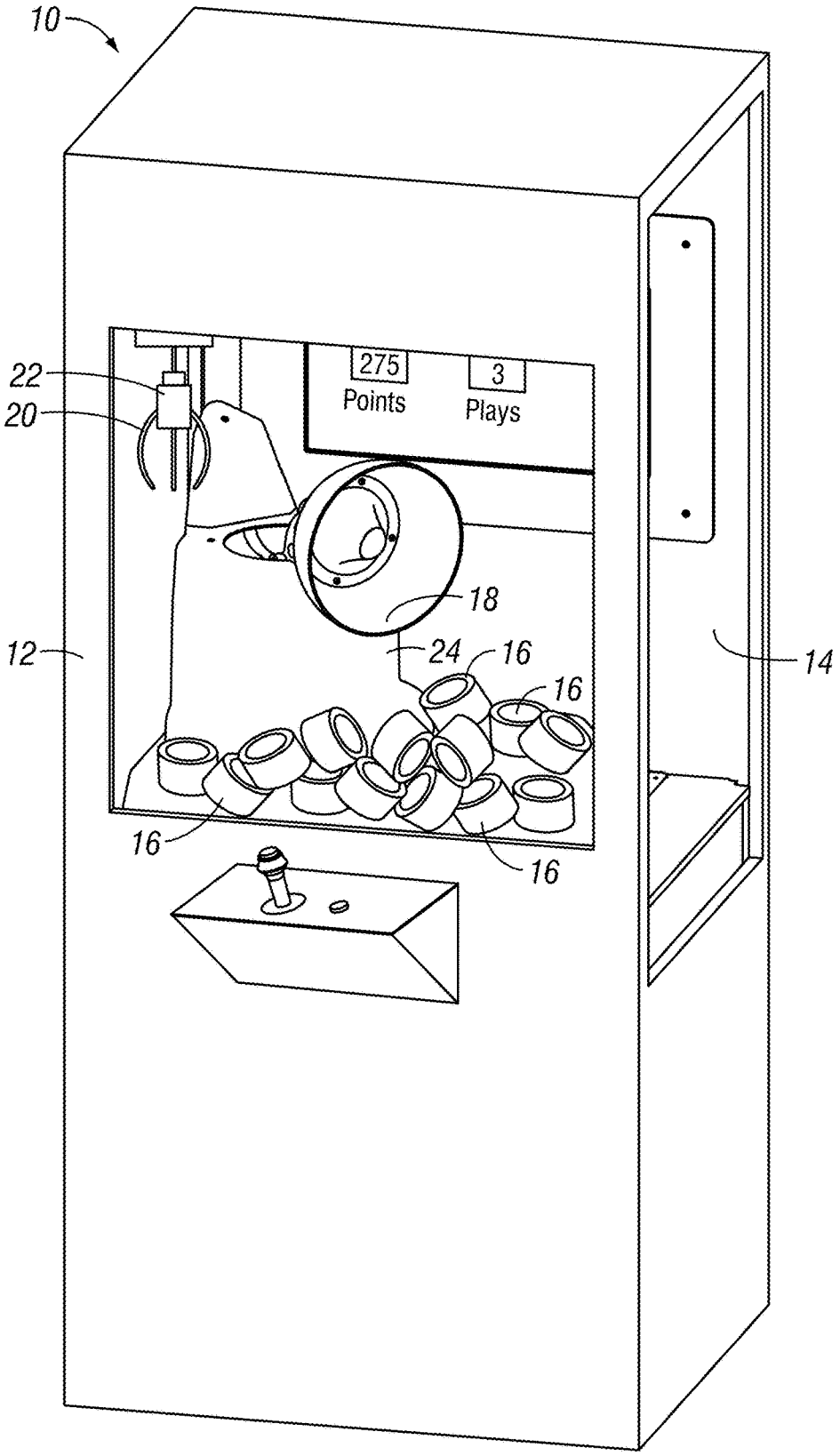
FIG. 1A is a perspective view of an arcade game including a rotating tilting prize receptacle.

The invention is directed towards an arcade game 10 (FIG. 1), and more specifically but not exclusively toward a crane-style arcade game. Unlike traditional crane-style games, the game 10 does not include a chute for a player to retrieve a prize that has been grasped and released by the crane. Instead, the prizes 16 remain in the housing 12. Each prize 16 includes an RFID marker 102 (See FIG. 13) and that gets read by an RFID reader. After a prize is "won" by being grasped by the crane 20 and successfully dropped into a prize receptacle 18, the prize value is read by the RFID reader and credited to the player. To improve the accuracy of reading the RFID tags 102, the receptacle 18 spins to pass the captured prizes past the reader's antenna 50 (see FIGS. 5-6) multiple times. Furthermore, each RFID tag is assigned a serial number that is read by the RFID reader to assure that captured prizes are not counted multiple times. After the RFID tags have been read, the receptacle 18 is tilted (see FIGS. 8-10), preferably while still spinning, to dump the prizes 16 back into the playing area 14. The receptacle 18 is provided on a captured-prize handling apparatus 30 (FIGS. 4-10) that includes the structure needed to spin and tilt the receptacle 18 as well as read the RFID tags 102 on the captured prizes 16. The captured-prize handling apparatus may include a lighted tower 32 that surrounds the electro-mechanical elements and attracts attention to the game. The receptacle 18 (see especially FIGS. 11 & 12) is shaped to urge the captured prizes 16 into a position within the receptacle 18 that enhances accurate reading of the RFID tags.

According to another feature, the arcade game may permit a player to capture physical prizes using an electro-mechanical device, whereby the prizes are assigned point values, and the point values may be redeemed both to play the game and to collect awards, such as tickets. The arcade game includes a video display screen that keeps track of the total prize value accumulated during a single play of the game. For example, if a player has successfully captured three prizes worth 75, 150, and 50 points respectively, the video display screen would show that the player has won 275 points. The display screen may also show how many plays the player has remaining. The player may redeem those points for tickets, or, may redeem some of those points for additional plays of the game. For example, if the "price" of a ticket is set at five (5) points and the price of a replay is set at twenty-five (25) points, a player could redeem 200 of the points for forty (40) tickets and the remaining seventy-five (75) points could be redeemed to play the game three (3) more times. A game operator can set the price, or point-value, of the tickets and game play as desired. According to some embodiments, a player is awarded points upon the insertion of money or other payment, such that upon initiating play a player starts with a point balance and any point value of selected prizes is added to the initial points, less any points redeemed to play the game.

Figure 1B:
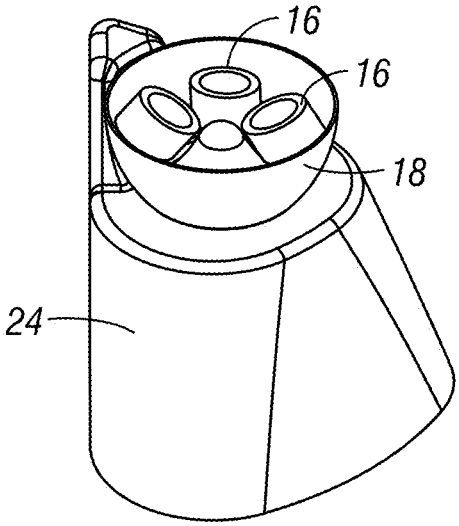
FIG. 1B is a detail view of the prize receptacle of FIG. 1A in an upright position containing captured prizes.
Figure 1C:
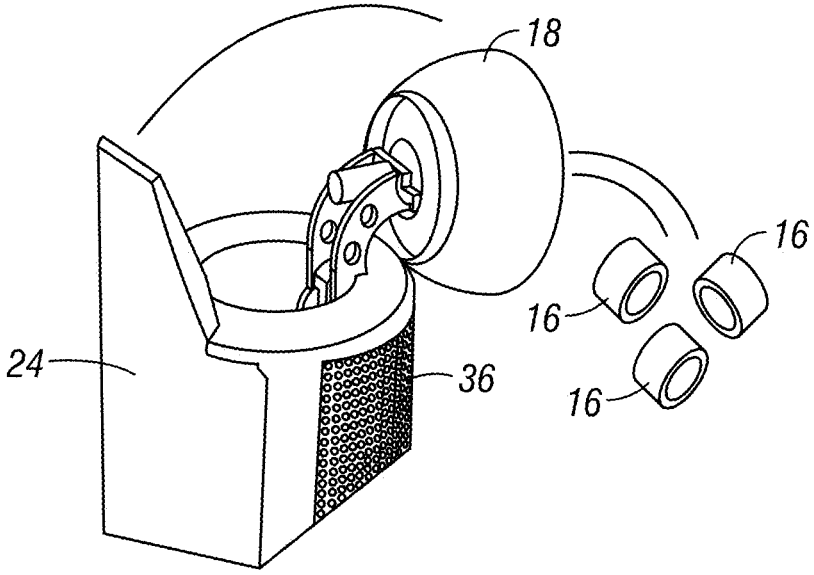
FIG. 1C is a detail view of the prize receptacle of FIG. 1B adjusted to a dumping position to eject the captured prized back into the playing field.

Referring to FIG. 1, a crane game 10 is shown. A crane-style game may include a housing 12 that defines an enclosed chamber 14 with prizes 16 inside distributed therein. Transparent windows 17 of housing 12 may allow a player to view prizes 16 without having direct access to them. A claw 20 or other grabbing mechanism is connected to a crane 22. The claw 20 may include a number of different types of grabbing mechanisms. For example, the claw 20 may include a magnet, arms, fingers, pincher, or similar mechanism for grabbing or attaching to a prize 16 within the chamber 14. As is well-known in the art, a player control is used by a player to move the crane 22 in an x-y plane (generally horizontal) relative to the prizes 16 within chamber 14. The player selects a prize(s) 16 that they hope to collect and attempts to position the claw 20 vertically over the selected prize(s) 16. Another manual player control, such as a button causes the crane 22 to drop claw 20 down with the claw jaws open, close the jaws, and lift claw 20 upward. The button may be part of or incorporated into the player control. If the operator is successful at positioning claw 20 and the claw 20 drops in such a position that its jaws grasp at least a portion of prize 16, and the jaws grasping strength is sufficient to hold prize 16 when lifted, the operator either moves crane 22 to a position, or game 10 automatically moves crane 22 to a position where claw 20 would open and drop prize 16. A solenoid controls the opening and closing of the claws 20 and may be of variable strength to make holding on to prizes easier or more difficult depending on a desired winning percentage. These features are shared by many traditional crane-style games as shown and described in U.S. Pat. Nos. 6,283,475 and 8,251,369, which are herein incorporated by reference in their entirety.

Unlike traditional crane-style games, the game 10 of FIG. 1 does not include a chute for a player to retrieve a prize 16 that has been grasped and released by the crane 22. Instead, the prizes 16 remain in the housing 12. Each prize 16 includes an RFID tag and that gets read by an RFID reader.

Uniquely, the prizes 16 are released into a receptacle 18 that is supported above the prizes 16 in the playing area by a support tower 24. The receptacle 18 spins to move captured prizes 16 within it past an RFID antenna attached to an RFID reader (see FIGS. 5-10 and 12). After the values of the tags on the captured prizes have been successfully read and the points credited to the player, the rotating receptacle 18 is tilted to dump the prizes 16 back into the playing area. The rotation of the receptacle during dumping helps to fling the prizes 16 back into the playing area rather simply drop them, which tends to randomize the resting location of the prizes 16 and avoids creating a pile of prizes at a dumping location.

Figure 2:
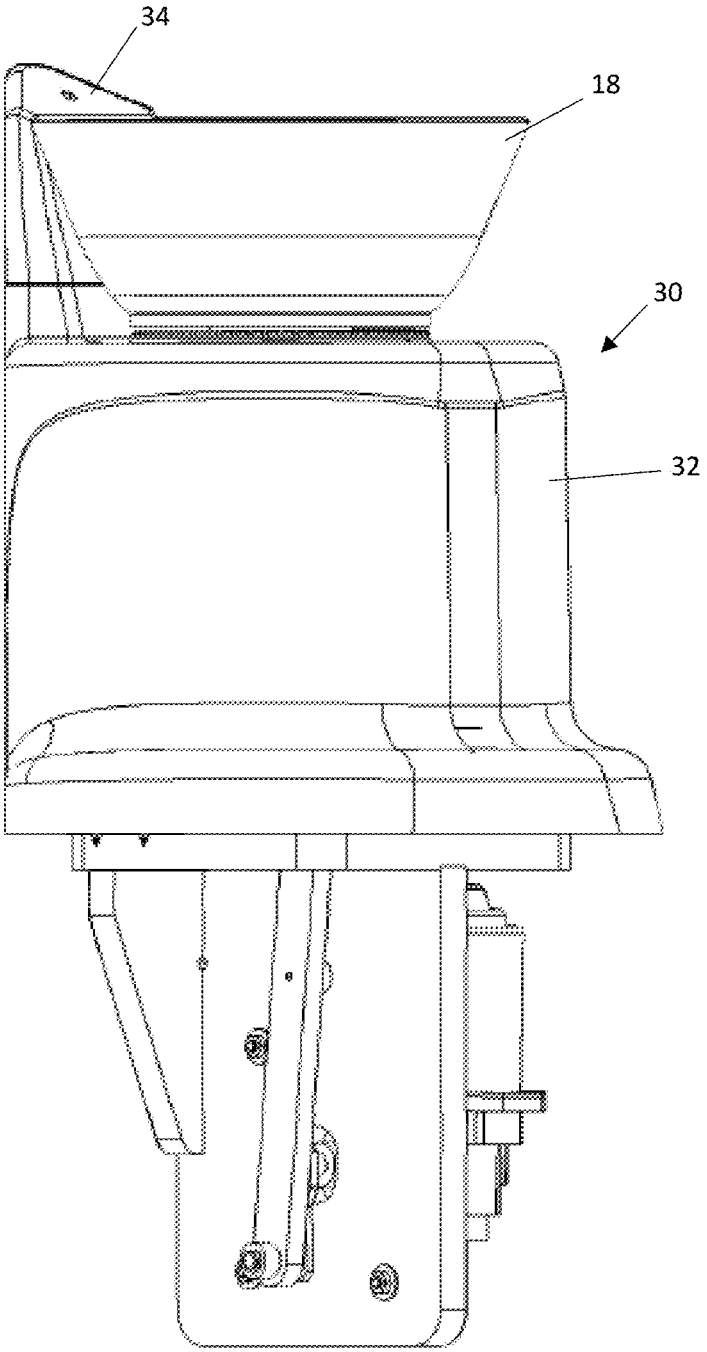
FIG. 2 is a front elevation view of a captured-prize handling apparatus for use in an arcade game according to one embodiment of the present invention.
Figure 3:
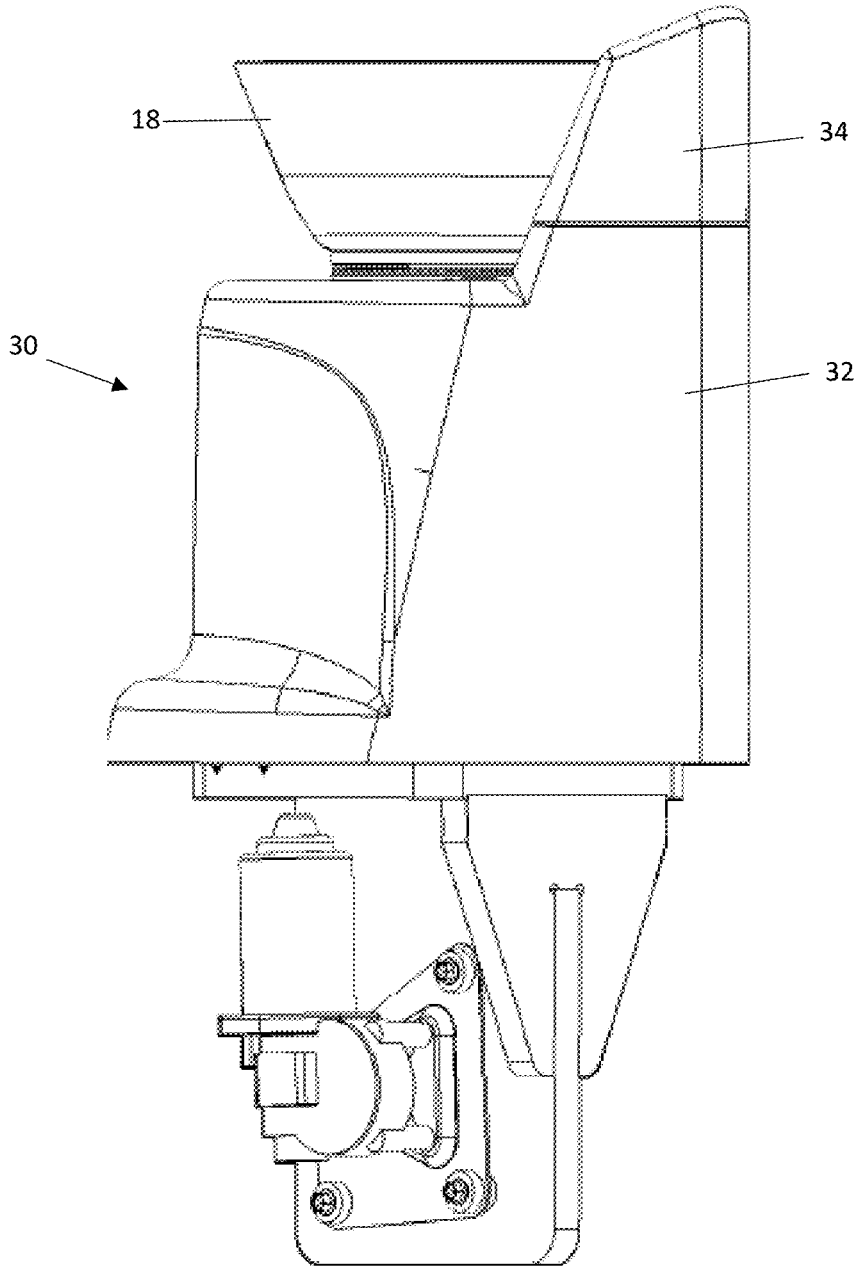
FIG. 3 is a rear elevation view of the captured-prize handling apparatus of FIG. 2.

FIGS. 2 and 3 show elevation views of a captured-prize handing apparatus 30 according to one embodiment of the invention. The captured-prize handling apparatus 30 of FIGS. 2-3 is adapted to fit in a rear corner of a playing area of an arcade game. The shape of the outer shell components of the apparatus 30 could be modified to accommodate other locations. The apparatus 30 includes a lower cover 32 that keeps the prizes 16 from interfering with the internal components of the apparatus 30 and provides an aesthetically pleasing appearance. Clear or translucent plastic may be used for the cover 32 to facilitate use of LED or other lighting within the apparatus 30 to draw attention to the game and indicate status. An upper cover 34 is also provided to protect and hide from view the RFID antenna. The upper cover 34 is preferably shaped to match the contours of the lower cover 32. The upper cover 34 needs to be transparent to the radio frequency of the RFID system.

Figure 4:
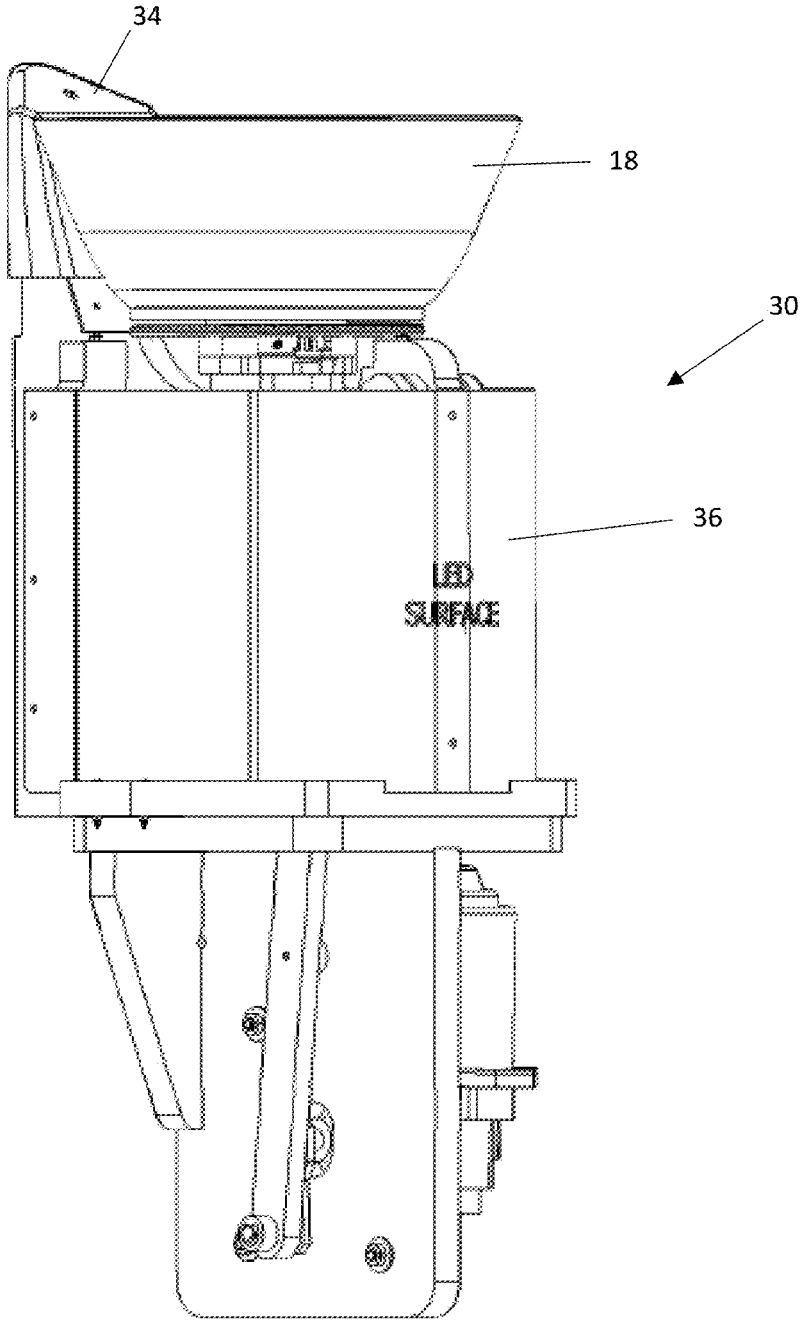
FIG. 4 is a front elevation view of the captured-prize handling apparatus of FIG. 2, with its outer cover removed to show LED lighting provided on the apparatus.

FIG. 4 shows the apparatus 30 with the lower cover 32 removed to show a grid of RGB LEDs 36. The RBG LEDs form a light source that can be used to provide lighting effects to the game. The grid 36 surrounds an upper portion of the internal components of the apparatus 30. The LEDs in the grid 36 are used to create unique visual effects that draw attention to the game, such as wave patterns, wipe patterns and flashing and pulse effects. The LEDs in the grid 36 can also be programmed to produced varied effects depending on the status of the game. For example, in an attract mode when the game is idle, the LEDs might pulse of flash rapidly to draw potential player's attention to the game. During play, the lights might change depending on what is happening. For example, the entire grid 36 might be green when the player is attempting to pick up prizes, might turn yellow as the RFID reader attempts to determine the value of any prizes that are won, and various pattern effects might be used to indicate that points have been won, which effects can be varied depending upon the value of the prizes won.

Figure 5:
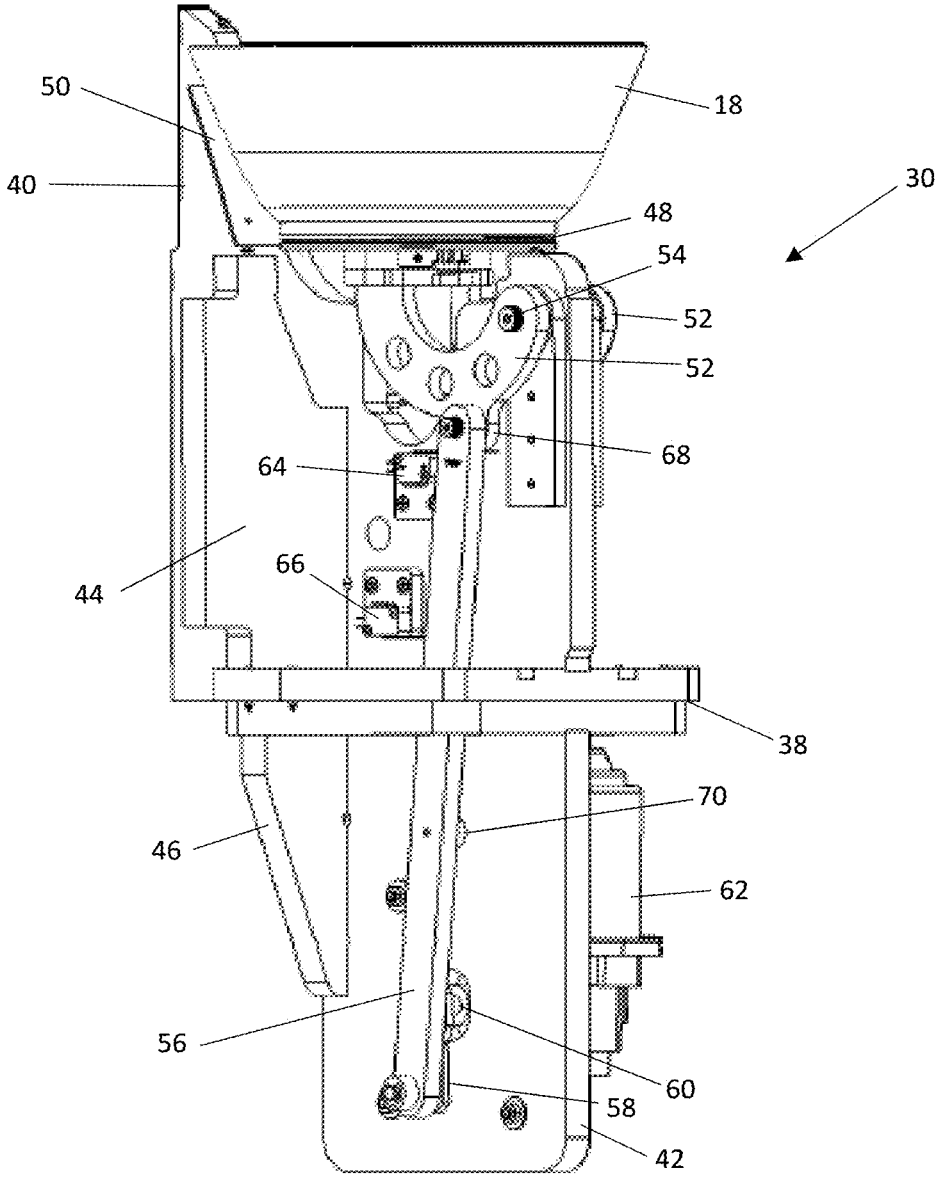
FIG. 5 is a front elevation view of the captured-prize handling apparatus of FIG. 2 with the covers and LED lighting removed to show the inner workings of the device.
Figure 6:
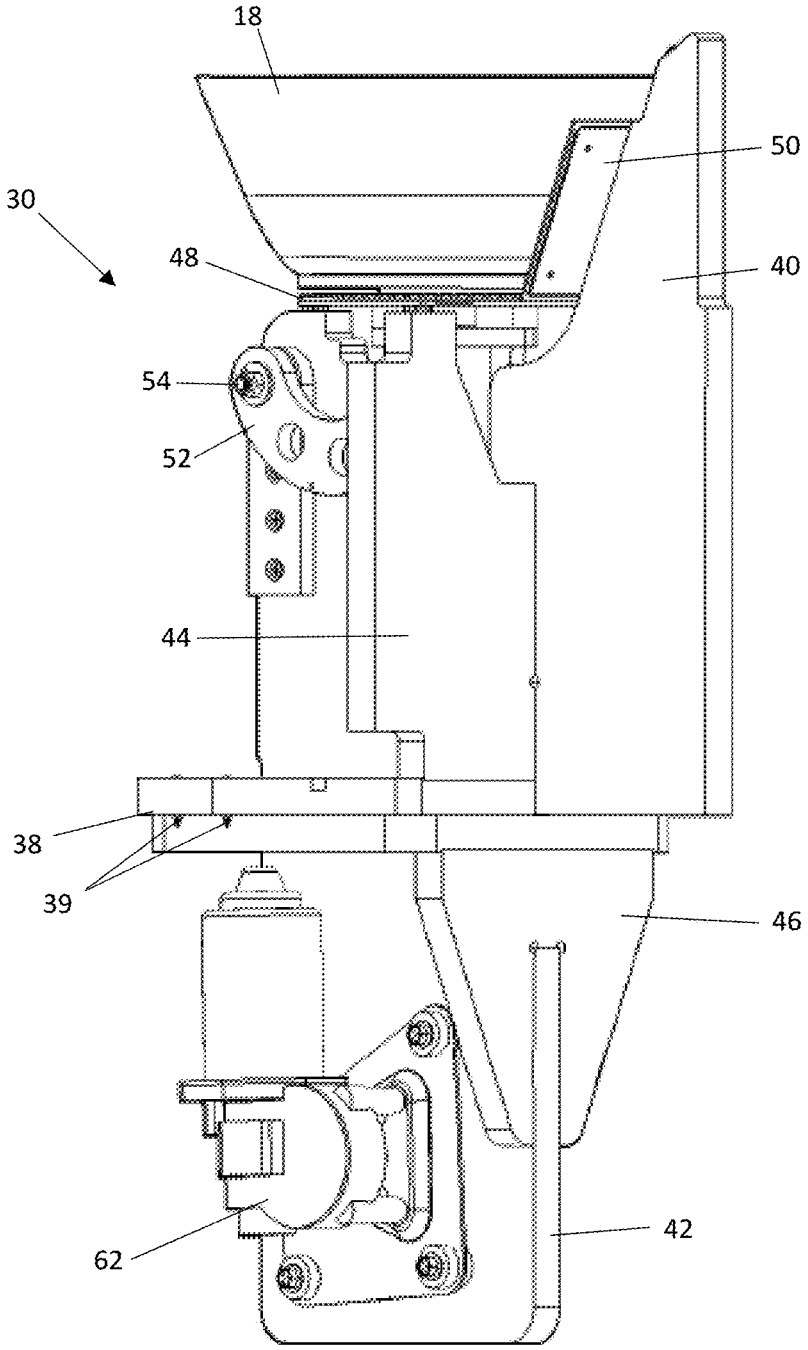
FIG. 6 is a rear elevation view of the captured prize handling apparatus of FIG. 5.
Figure 7:
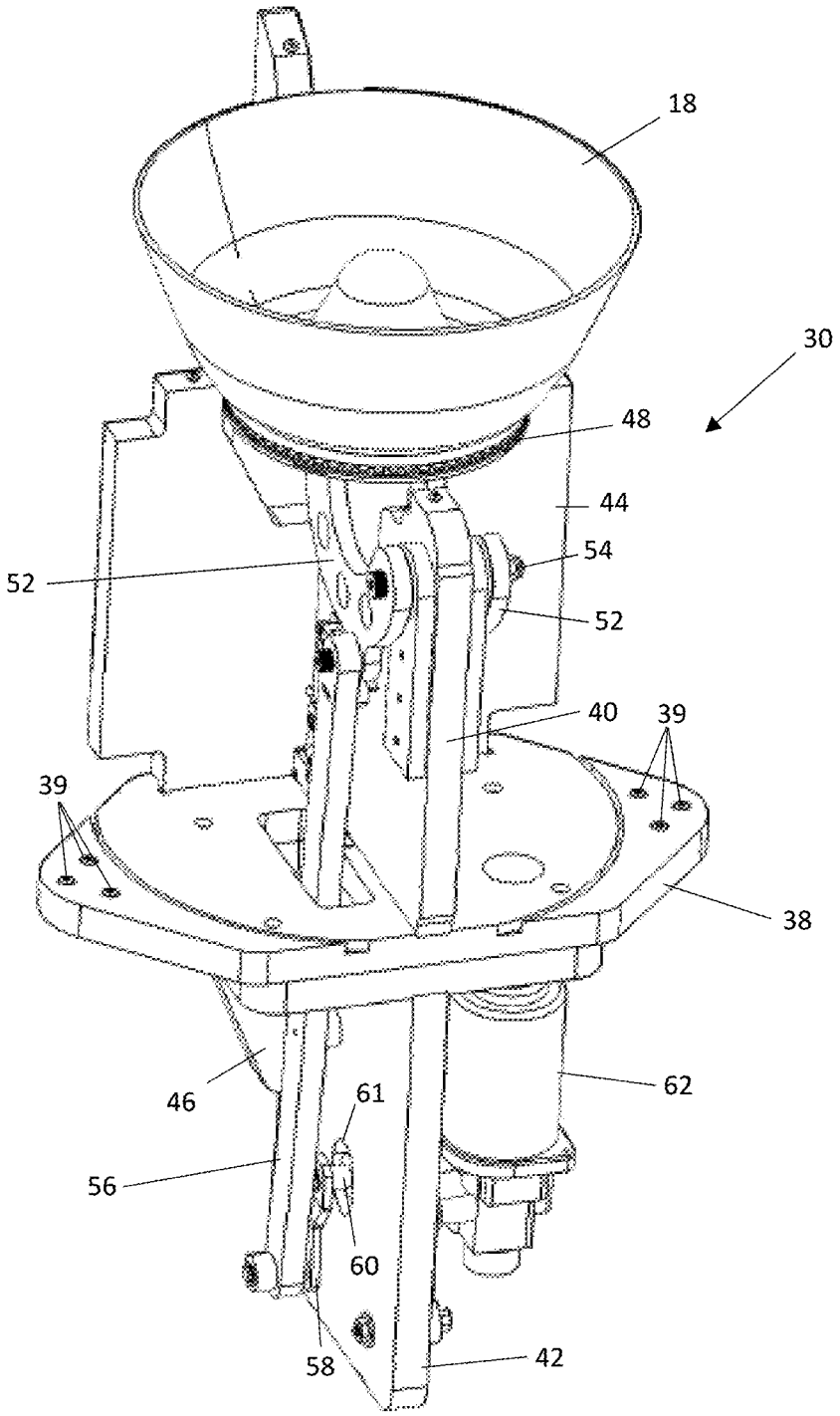
FIG. 7 is an isometric view of the captured prize handling apparatus of FIG. 5.

FIGS. 5-7 show the captured-prize handling apparatus 30 with the covers 32, 34 and the light grid 36 removed to reveal the internal electromechanical elements. The apparatus 30 includes a horizontal base 38, an upper vertical riser 40, a lower vertical riser 42 and upper and lower rear flange 44 and 46 that provide the structural backbone of the apparatus 30. The horizontal base 38 mounts to the floor of the prize area, for example with threaded connectors 39, to at least partially secure the apparatus 30 to the game 10.

The receptacle 18 is in an upright untilted position in FIGS. 5-7 such that it is oriented to receive and retain captured prizes. The receptacle 18 is mounted to a rotatable base 48, by threaded connectors (not shown), or other known mechanisms. LEDs or other light sources (not shown) may be provided in the base 48 to provide additional lighting effects. In particular, it may be advantageous to light and spin the base 48 during a player attract mode.

The base 48 is tiltably mounted to the upper riser 40 via pivot arms 52. The pivot arms 52 are fixed to the underside of the base 48 and pivotally connected to the upper riser 40 by pivot member 54. The pivot arms 52 may include a plurality of mounting openings for receiving the pivot member 54 such that the pivot arms can be used modularly in a variety of sizes of devices. The pivot point (pivot member 54) is offset below and to the front of the base 48.

A rod 56 is pivotally connected to one of the pivot arms 52 and extends downwardly from the pivot arm 52 through an opening in the base 38 where the rod 56 is pivotally connected to lever 58. Lever 58 is fixed to shaft 60 that extends through an opening 61 in lower riser 42 and is rotated by actuator 62. The lever 58 rotates in a full circle. At or near the six o'clock position for the lever 58, the receptacle 18 is in the horizontal prize retaining position shown in FIGS. 5-7. When the lever 58 is rotated to near the twelve o'clock position, the receptacle 18 is in the full tilted dumping position of FIGS. 8-10.

An upper limit switch 64 (FIGS. 5, 9, & 10) and a lower limit switch 66 (FIGS. 5, 9 & 10) are mounted on the same side of the upper riser 40 as the rod 56. The limit switches are operably connected to the actuator 62 and are used to stop the actuator 62 with the lever 58 in the desired positions. In particular, the upper limit switch 64 is contacted by a protrusion 68 on one of the pivot arms 52 when receptacle is in the horizontal prize retaining position of FIGS. 5-7. The lower limit switch 66 is contacted by a limit member 70 mounted on the inside of rod 56 when the receptacle is in the desired tilted dumping position shown in FIGS. 9-10.

An RFID antenna 50 is mounted to the upper vertical riser 40 proximate to the receptacle 18 so that the antenna 50, which is attached to an RFID reader, is positioned to accurately read RFID tags on captured prizes that have been dropped into the receptacle 18. According to one embodiment, the RFID reader is a 13.56 MHz HF midrange reader from FEIG Electronics Model Number: ID ISC.MR102. The RFID tags on the prizes can be high frequency (HF) tags such as 13.56 MHz tags, for example tags sold under the brand name Indentiv, Part No. TR-01PADIAO 331. Other suitable combinations of readers and tags may be used.

Figure 8:
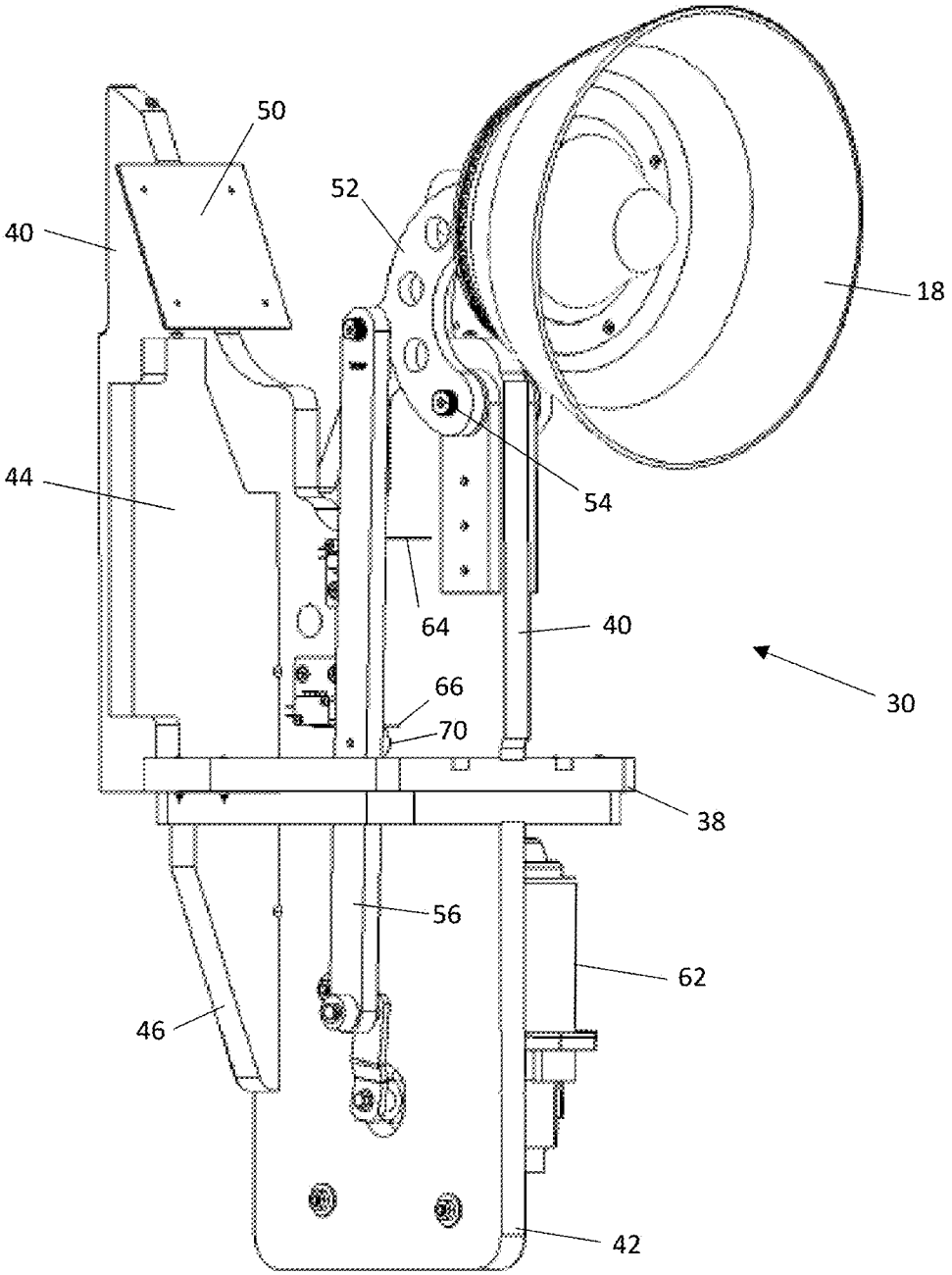
FIG. 8 is a front elevation view of the captured-prize handling apparatus of FIG. 2 with the prize receptacle adjusted to a tilted position to dump captured prizes back into the playing area and with the covers and LED lighting removed to show the inner workings of the device.
Figure 9:
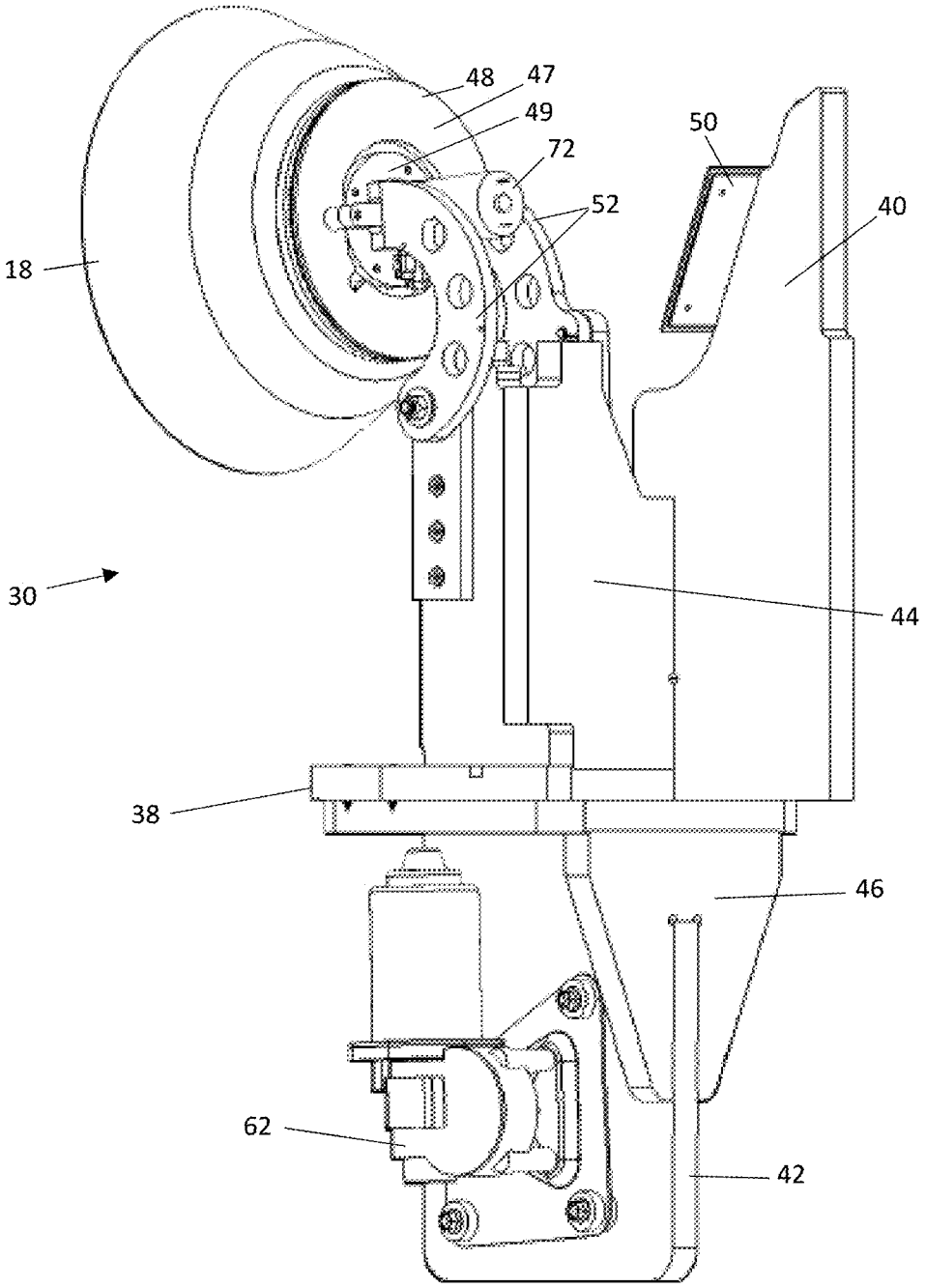
FIG. 9 is a rear elevation view of the captured-prize handling apparatus of FIG. 8.
Figure 10:
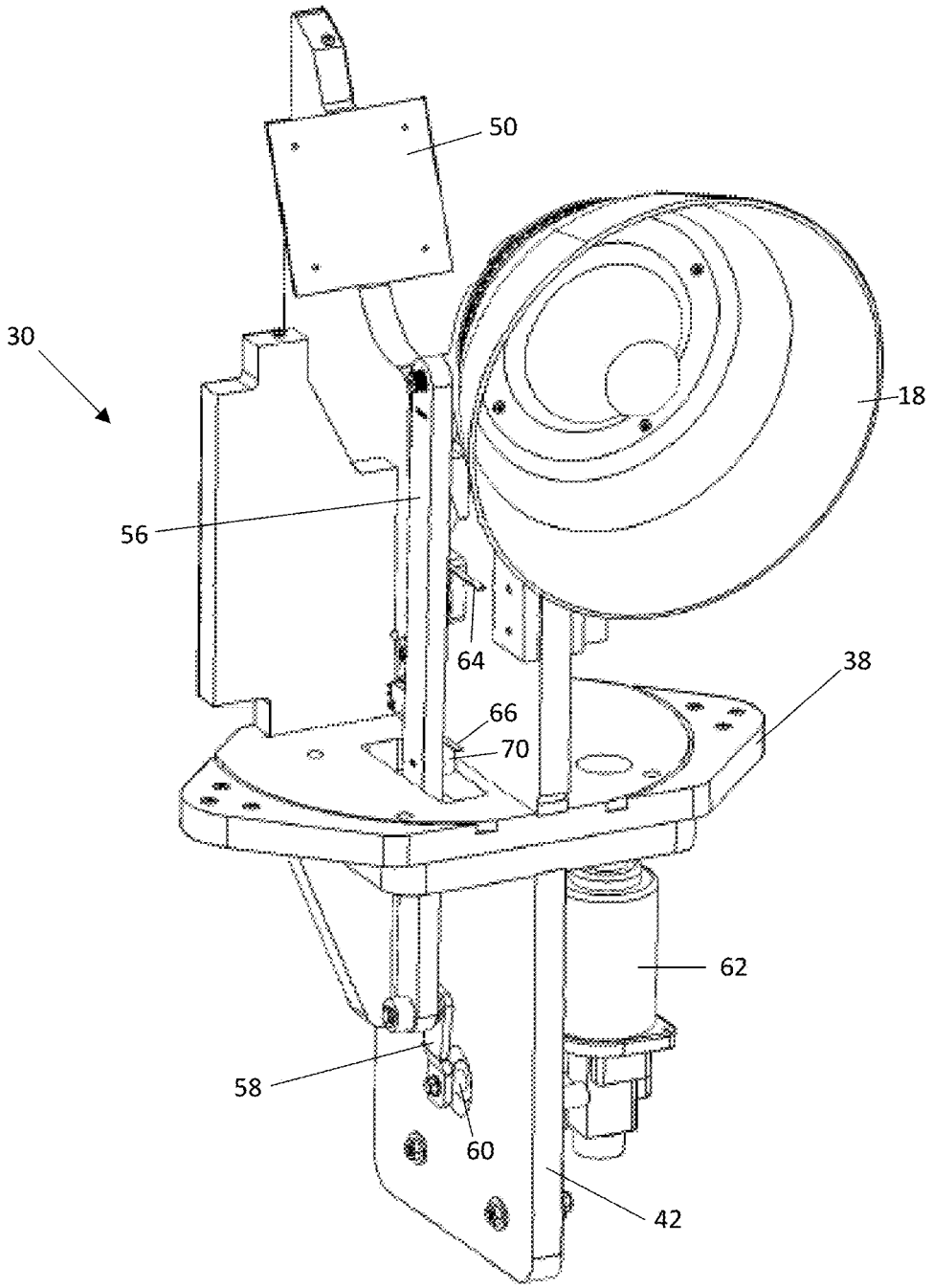
FIG. 10 is an isometric view of the captured prize handling apparatus of FIG. 9.

FIGS. 8-10 show the apparatus 30 with the receptacle 18 tilted into a dumping position. To accomplish this, the actuator 62 has rotated shaft 60 until the lever 58 is in nearly an upright (twelve o'clock) position, which correspondingly drives rod 56 upward. The upward movement of rod 56 pushes the connected pivot arm 52 upward causing it to rotate about pivot point 54 to thereby tilt the receptacle 18. When the rod 56 reaches the position of FIGS. 8-10, the limit member 70 contacts the lower limit switch 66 causing the actuator to stop rotating shaft 60 to maintain the apparatus with the receptacle in the tilted dumping position. Preferably, in the titled dumping configuration of FIGS. 8-10, the receptacle is tipped at 90 degrees or greater relative to its horizontal position. When it is desired to rotate the receptacle 18 back to the prize retaining orientation of FIGS. 2-7, the actuator 62 again rotates shaft 60 until the lever 58 until the protrusion 68 on pivot arm 52 contacts the upper limit switch 64 causing the actuator 60 to stop rotating shaft 60 and maintain the receptacle in the horizontal prize retaining orientation.

A rotation motor 72, best seen in FIG. 9, is mounted between arms 52 and secured to a stationary bottom portion 47 of rotatable base 48. The rotation motor 72 has an output shaft connected to drive a rotatable portion 49 of rotatable base 48 that in turn drives receptacle 18. The rotation motor 72 tilts with the receptacle 18, such that the motor 72 can cause the receptacle to spin when the receptacle 18 is in the horizontal prize retaining orientation (FIGS. 2-7), the tilted dumping orientation (FIGS. 8-10), or while the receptacle 18 is moving between positions.

Figure 11:
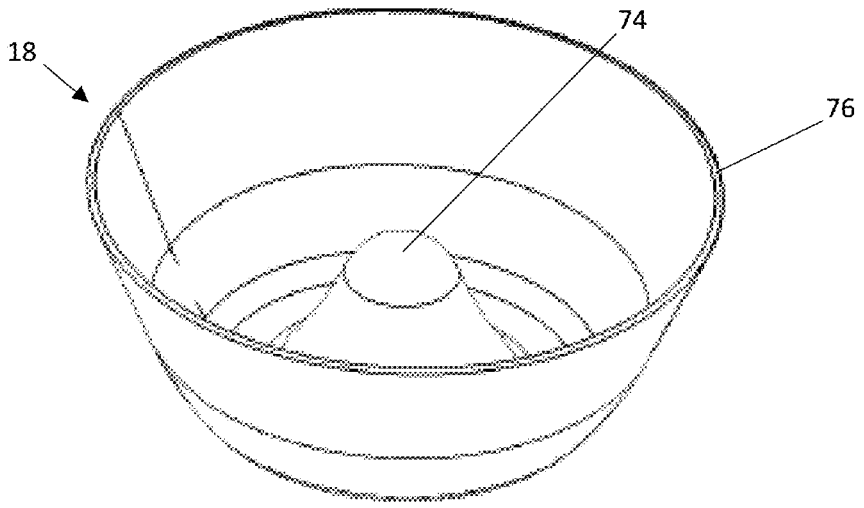
FIG. 11 is an isometric view of a receptacle according to one embodiment of the present invention.
Figure 12:
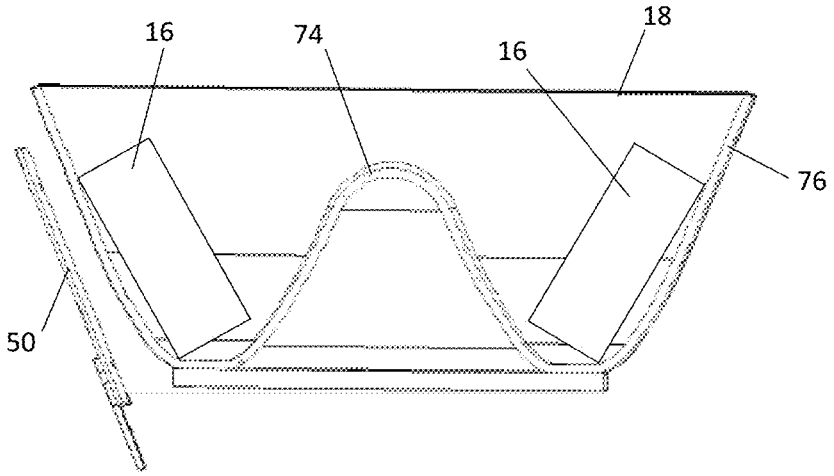
FIG. 12 is a partial cross-sectional view showing captured prizes in a receptacle and the RFID reader.

Details of one configuration for the receptacle 18 can be seen in FIGS. 11 and 12. In the receptacle 18 of FIGS. 11 and 12, the receptacle 18 is a bowl that has a rounded convex center 74. The convex center 74 extends about two thirds of the height of the outer wall 76 of the bowl. The convex center 74 slopes radially downward and outward such that any prizes 16 in the receptacle 18 are urged toward the outer wall 76 of the receptacle. The outer wall 76 has a gradually inward and downward slope to retain prizes within the receptacle 18.

As best seen in FIG. 12, when captured prizes 16 are within the receptacle 18 the receptacle 18 can be rotated to bring the prizes 16 in close proximity to the RFID antenna 50. The combination of the slopes of the convex center 74 and the outer wall 76, along with the radial outward acceleration caused by rotation of receptacle tends to orient the prizes 16 as shown in FIG. 12 to the best orientation to read the RFID tags on the prizes. Furthermore, the prizes can be rotated past the antenna 50 a few times in a short period of time to assure that each prize 16 gets recognized. Preferably, each prize 16 has an RFID tag with a unique serial number so that the RFID reader can accurately determine how many prizes are within the receptacle and the RFID reader will not double (or more) count a single prize 16. Accordingly, the combination of better orientation, close proximity to the antenna 50, multiple passes by the antenna, and serial identification of each prize 16 greatly improves the accuracy of the reading of the captured prizes 16.

Figure 13:
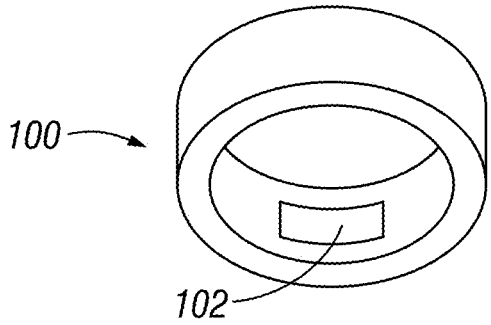
FIG. 13 is an isometric view of a ticket ring with an RFID marker that may be used as a prize to be captured in the arcade game described herein.

FIG. 13 shows one embodiment of a ticket ring 100 that has an RFID tag 102. The RFID tag 102 will be programmed to include both a point value and an individual serial or ID number. The ticket ring 100 can serve as the prize 16 to be captured in the game 10. The ticket rings 100 may be assigned point values that correspond to the number of tickets in the ring. Rings 100 with more tickets will weigh more than rings 100 with less tickets making them more difficult to successfully capture and move to the receptacle 18. Other physical items may be used instead of ticket rings.

The point values may be redeemed both to play the game and to collect awards, such as redeemable tickets or tokens, or points added to a player's account tracked on a magnetic strip card or other account tracking mechanism. The arcade game includes a video display screen (FIG. 1 that keeps track of the total prize value accumulated during a single play of the game. For example, if a player has successfully captured three ticket rings worth 75, 150, and 50 points respectively, the video display screen would show that the player has won 275 points. The display screen may also show how many plays the player has remaining. The player may redeem those points for physical tickets or prizes, or, may redeem some of those points for additional plays of the game.

In use, a user applies credit which allows the user to control the crane 22 on an X, Y, Z axis. Using the X and Y axis the user positions the grappling device 20 over the desired target within the gameplay field. The desired target may be a roll of tickets with an applied RFID tag. At which time the user presses the catch button. After depressing the catch button, the grappling device 20 descends the Z axis to obtain the desired target. The grappling device then ascends back up the Z axis and transports the target to its destination. The destination is the rotating receptacle 18 with a rounded convex center 74 to keep the now captured prizes 16 on the outside edge. The RFID antenna 50 positioned adjacent to the outer edge of the receptacle 18 attains the information on the RFID tags of the captured prizes 16. After obtaining the information the receptacle 18 tips at a 90 degree or greater angle to eject the prizes 16 back into the gameplay field. The rotation of the receptacle 18 may also be used to impart sideways motion to the prizes 16 as they dumped from the receptacle 18 back into the gameplay field in order to increase the random distribution of the prizes in the gameplay field. Furthermore, the rotation of the receptacle 18 may be used, especially when combined with the lights 36 in the tower and the in the rotating base 48, to draw attention to the game when the game is in an attract mode between plays.

The present invention contemplates numerous variations, options and alternatives, and is not to be limited to the specific embodiments described herein. Other changes are part of the present invention.

What is claimed is:

1. An arcade game comprising:

a housing;

a prize display area within the housing;

a prize receptacle adjacent to the prize display area;

an electro-mechanical prize capturing device mounted in the housing adapted to capture a prize having a marker with an assigned value from the prize display area within the housing and move the prize to the prize receptacle;

a rotation device that spins the prize receptacle about a generally vertical axis after the prize has been moved to the prize receptacle by the electro-mechanical prize capturing device;

a marker reader proximate to the prize receptacle that reads the marker on the prize within the prize receptacle as the marker is moved past the marker reader; and a tilting mechanism that tilts the prize receptacle after the marker reader has read the marker to thereby dump the prize back into the prize display area.

2. The arcade game of claim 1, wherein the marker is an RFID tag and the marker reader comprises an RFID antenna.

3. The arcade game of claim 2, wherein the prize is a roll of tickets.

4. The arcade game of claim 1, wherein the electro-mechanical prize capturing device comprises a crane and claw.

5. The arcade game of claim 1, wherein the prize receptacle comprises a bowl having a convex center portion that urges prizes toward an outer wall of the bowl.

6. The arcade game of claim 1, wherein the rotation device tilts with the prize receptacle such that the rotation device can spin the prize receptacle when the prize receptacle is in a horizontal prize retaining orientation and when the prize receptacle is in a tilted prize dumping orientation.

7. The arcade game of claim 6, wherein the arcade game is adapted to continue spinning the prize receptacle as the prize is dumped from the prize receptacle in order to impart sideways motion on the prize to prevent dumping the prize into a pile directly beneath the prize receptacle.

8. The arcade game of claim 1, wherein the marker reader is adapted to sense a unique serial number for each captured prize in order to prevent duplicate crediting of the prize.

9. The arcade game of claim 1, wherein the prize receptacle is supported on a support tower, and further wherein the support tower comprises an array of LEDs.

10. An arcade game comprising:

an electro-mechanical prize capturing device;

a receptacle, the receptacle being adapted to tilt between an upright position wherein the receptacle can receive and support prizes captured by the electro-mechanical prize capturing device and a tilted dumping position whereby the prizes captured by the electro-mechanical prize capturing device will be dumped out of the receptacle;

a rotation motor operably connected to the receptacle to cause rotation of the receptacle; and an RFID antenna located proximate to the receptacle adapted to read RFID tags on the prizes captured by the electro-mechanical prize capturing device within the receptacle as the receptacle is rotated by the rotation motor.

11. The arcade game of claim 10, wherein the electro-mechanical prize capturing device comprises a crane and a claw.

12. The arcade game of claim 10, wherein the receptacle, the rotation motor and the RFID antenna are part of a captured-prize handling apparatus, and wherein the captured-prize handling apparatus further comprises:

a horizontal base mounted to a floor within the arcade game;

an upper vertical riser extending upward from the horizontal base, wherein the receptacle is operably pivotally connected to the upper vertical riser;

a lower vertical riser extending downward from the horizontal base;

an actuator mounted to the lower vertical riser;

a receptacle base mounted to the receptacle, the receptacle base having a portion that is fixed relative to the receptacle and a portion that rotates relative to the receptacle; and a lever operably connected to the actuator at a lower end and operably connected to the receptacle base at an upper end; and wherein the rotation motor is mounted to the receptacle base.

13. The arcade game of claim 10, further comprising a tower structure that surrounds and hides the rotation motor from view of users when the receptacle is in an upright position.

14. The arcade game of claim 13, wherein the tower structure includes lights.

15. The arcade game of claim 10, wherein the rotation motor tilts with the receptacle to cause rotation of the receptacle in both the upright position and the tilted dumping position.

16. The arcade game of claim 10, wherein the receptacle includes a rounded convex center that slopes radially downward and out to urge any prize in the receptacle toward an outer wall of the receptacle.

17. A method of operating an arcade game having a prize display area within a housing and an electromechanical prize capturing device for capturing prizes from the prize display area, the method comprising:

capturing at least one prize within the prize display area and moving the at least one prize to a prize receptacle;

spinning the prize receptacle containing the at least one captured prize about a vertical axis;

reading at least one marker on the at least one captured prize in the spinning prize receptacle; and dumping the at least one captured prize back into the prize display area after the at least one marker has been read.

18. The method of claim 17, wherein dumping is accomplished by tilting the prize receptacle.

19. The method of claim 18, wherein the marker is an RFID tag and reading is performed using an RFID antenna connected to an RFID reader.

20. The method of claim 17, wherein the spinning of the prize receptacle continues during dumping in order to impart sideways motion on the at least one captured prize as the at least one captured prize is dumped to prevent dumping the at least one captured prize into a pile directly beneath the prize receptacle.

* * * * *